US007712721B2

(12) United States Patent
Scott

(10) Patent No.: US 7,712,721 B2
(45) Date of Patent: May 11, 2010

(54) SELF-DRYING CONDENSATE PAD FOR BEVERAGE AND FOOD SERVICE

(76) Inventor: Patricia Salton Scott, 19 Squires La., Saint Louis, MO (US) 63131

( * ) Notice: Subject to any disclaimer, the term of this patent is extended or adjusted under 35 U.S.C. 154(b) by 1212 days.

(21) Appl. No.: 10/800,712

(22) Filed: Mar. 16, 2004

(65) Prior Publication Data

US 2005/0205743 A1 Sep. 22, 2005

(51) Int. Cl.
*A47G 23/00* (2006.01)

(52) U.S. Cl. ..... 248/346.11; 248/306.01

(58) Field of Classification Search ..... 248/346.11, 248/346.01

See application file for complete search history.

(56) References Cited

U.S. PATENT DOCUMENTS

| | | | | |
|---|---|---|---|---|
| 2,709,905 | A * | 6/1955 | Dunlap | 248/346.11 |
| 3,268,198 | A * | 8/1966 | Swett | 248/346.11 |
| 4,089,498 | A | 5/1978 | Woodruff | |
| 4,858,872 | A * | 8/1989 | Witt | 248/346.11 |
| 4,858,873 | A | 8/1989 | Wilmouth et al. | |
| D357,388 | S * | 4/1995 | Gaffin | D7/625 |
| 5,938,162 | A * | 8/1999 | Honjo | 248/346.11 |
| 6,102,352 | A * | 8/2000 | Kvalvog | 248/346.11 |
| 6,306,123 | B1 | 10/2001 | Salerno et al. | |
| 6,448,466 | B1 | 9/2002 | Ribeiro de Carvalho | |
| 6,610,903 | B1 | 8/2003 | Latimer et al. | |
| 6,673,982 | B1 | 1/2004 | Chen et al. | |
| 6,695,272 | B1 * | 2/2004 | Bomgaars et al. | 248/346.11 |
| 6,774,067 | B2 * | 8/2004 | Demott et al. | 442/312 |
| 6,901,629 | B2 * | 6/2005 | Wurdack | 16/42 R |

OTHER PUBLICATIONS

Adanur, Sabit. Wellington Sears Handbook of Industrial Textiles, 1995, pp. 589,625,631, Lancaster, PA: Technomic Publishing Company.

USPTO, U.S. Department of Commerce. Classification Definitions, Dec. 2000 Edition, Secs. 215-1,25,26,27, Washington: GPO.

* cited by examiner

*Primary Examiner*—J. Allen Shriver, II
*Assistant Examiner*—Steven M Marsh

(57) ABSTRACT

A protective pad apparatus that prevents water damage and water pooling upon indoor surfaces. When placed between a receptacle of ice and its underlying surface, said surface is shielded from dripping condensate. The invention utilizes several fabric features of different densities that cooperate to absorb and then to disperse water. There is an absorptive upper portion, a wicking-barrier core, and an insulative bottom portion, all of which are permanently attached to create a pad. The pad apparatus is of a capacity and size to function as an adjunct to vessels containing many servings of a beverage or food.

1 Claim, 4 Drawing Sheets

FIG. 1
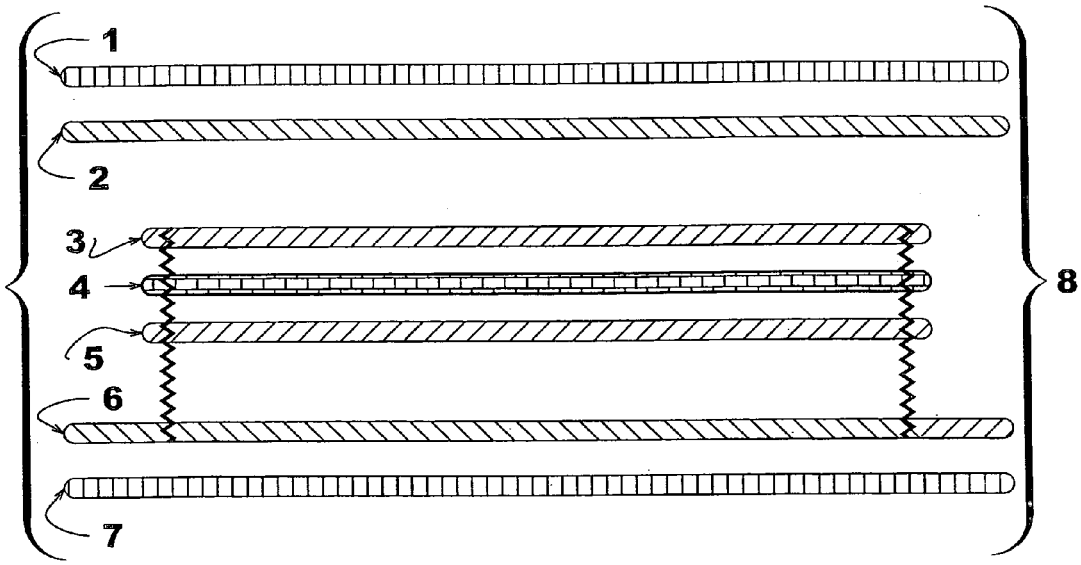
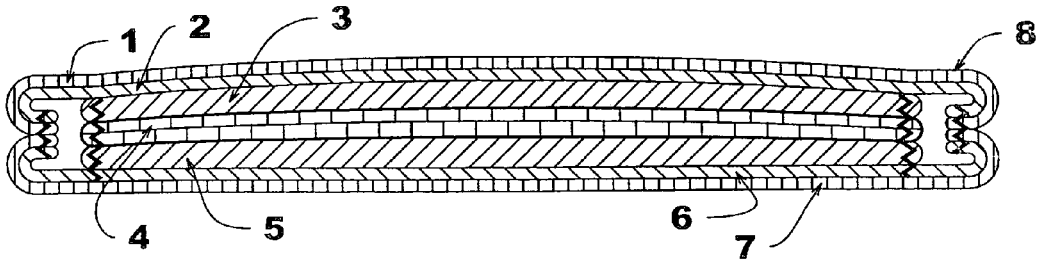
FIG. 2

FIG. 3
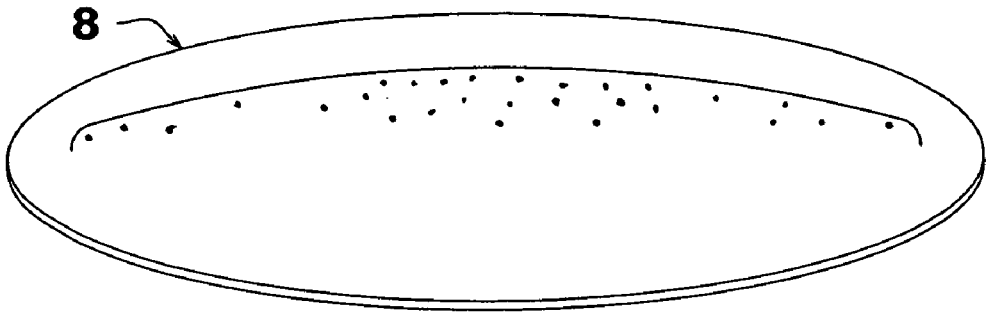
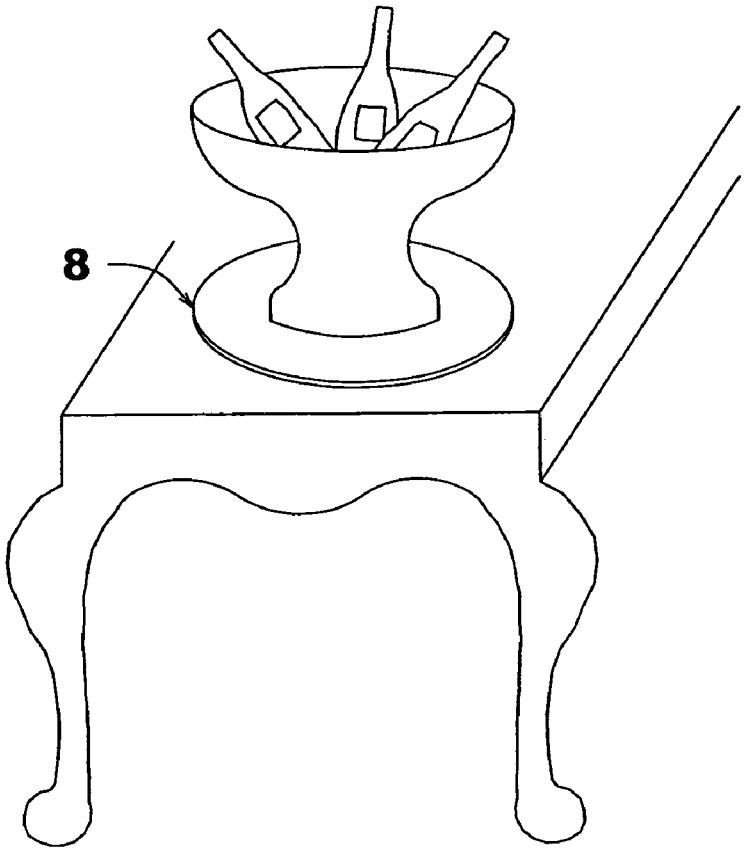
FIG. 4

FIG. 5
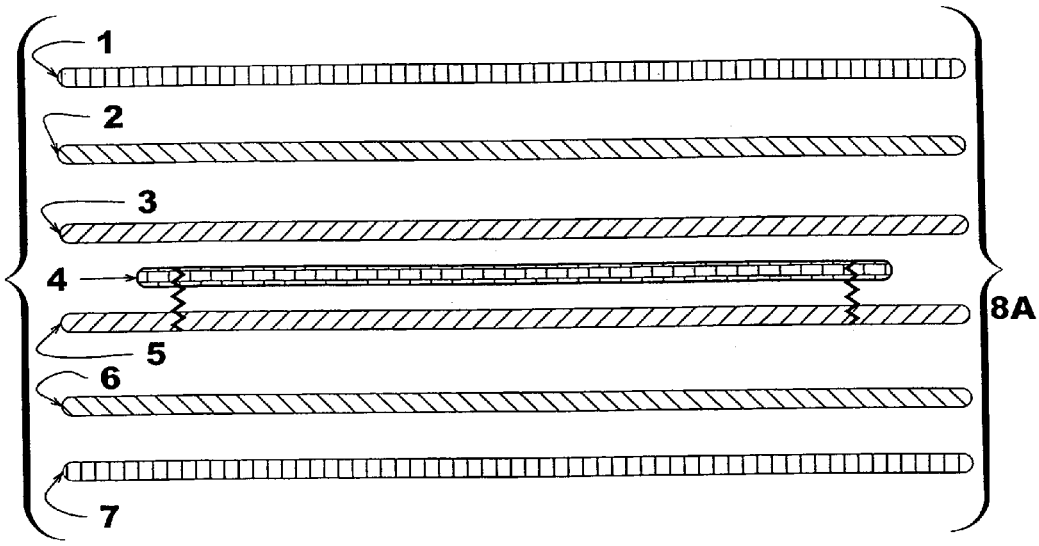
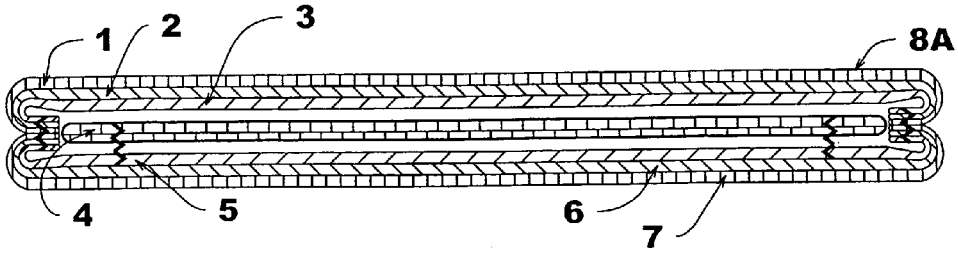
FIG. 6

SELF-DRYING CONDENSATE PAD FOR BEVERAGE AND FOOD SERVICE

CROSS-REFERENCE TO RELATED APPLICATIONS

This Application claims priority from U.S. Provisional Application No. 60/454,007 filed Mar. 13, 2003.

STATEMENT REGARDING FEDERALLY SPONSORED RESEARCH

Not applicable

REFERENCE TO COMPACT DISK APPENDIX

Not applicable

BACKGROUND OF THE INVENTION

Referring to USPTO Classification Definitions, the present invention is relevant to Class 215 Bottles and Jars, but specifically to subclass 392 Drip-catching Attachment. Subclass 392 "[. . . ] is indented under subclass 386 [Attachment or Adjunct]", which classifies "Subject matter including a structure to absorb or collect moisture of condensation or drip accumulation on the exterior of a bottle, jug, or jar". Bottles, jugs, and jars have in common that they are vessels of a capacity to hold multiple servings of their intended contents. This distinction is relevant to the present invention, which is a pad apparatus that operates as an adjunct to jug-type vessels used in beverage and food service. There are many kinds, but each has in common that they are vessels that maintain multiple servings of chilled items at temperature with ice. Such vessels are positioned over or upon this pad apparatus.

The present invention is a new pad apparatus designed to first absorb and then disperse condensate runoff generated by ice-filled containers. Such containers, as wine coolers and chafing dishes, are widely used for serving beverages and food during social occasions. It is usual in a party setting for the aforementioned containers of ice to sweat for many hours, resulting in an untidy pool of water, or water damage to an underlying surface. The present invention addresses these issues of untidiness and damage.

Prior art relating to the present invention falls into two groups: traditional methods and the published prior art of the USPTO. The traditional methods include under liners, furniture toppers, and glass sheeting. Published prior art relates to the present invention less specifically, but in the interests of diligence and thoroughness, two comparable technologies will be discussed: coasters and exudate pads.

The first traditional method under consideration is the use of an under liner. Wine coolers containing one or more bottles, as well as the necessary amount of ice to maintain temperature, are often placed upon a folded towel lying on a platter. In the restaurant trade this combination of a plate and cloth is referred to as an under liner. Under liners have limited efficacy to absorb and isolate condensate runoff because, as the cloth saturates and the platter becomes very cold, secondary condensate invariably forms beneath the platter resulting in damage to a vulnerable surface. It is also disadvantageous that under liners must be emptied to prevent them from spilling over. Hence there is a need for a protective device that is able to insulate an underlying surface from cold, and, that can absorb and disperse moisture over many hours of use without being attended.

The second traditional method for protecting surfaces is to use a custom furniture topper. Toppers cover an entire tabletop and are generally made from thick, rigid materials such as particleboard or laminated cardboard that have been covered with vinyl or fabric. While toppers are effective barriers against water and temperature extremes, they have many disadvantages. The primary disadvantage is that toppers are custom made in the shape of their intended tabletops, typically for a dining room table, and so are not practical for use throughout a home. Toppers are also expensive, are bulky to store, and they obscure the beauty of fine furniture. Because toppers are not esthetically appealing, they are customarily covered with tablecloths. Tablecloths exacerbate the problem by covering beautifully carved table legs, marquetry, wood grain and other decorative details. Therefore, it would be advantageous for a protective device to be transferable to any household surface, to be inexpensive, space saving, and that does not detract from the beauty of household furnishings.

Another traditional method of protecting tabletops is to cover them with a sheet of glass, similarly as a topper. All of the disadvantages of toppers also apply to glass sheeting except that glass does not obscure the beauty of fine furnishings. The primary disadvantage of glass is that it allows water to untidily pool and flow across its surface, dampening cocktail napkins and elbows alike. Glass sheeting adequately isolates water from a furniture surface, but it does not prevent the untidiness of pooled water.

It is an overall disadvantage of traditional methods such as under liners, toppers and glass that they do not meet the needs of contemporary home entertaining. Sit-down dinners attended to by domestic employees and staged in a formal dining room are no longer as common as they once were. Architects and builders have acknowledged this lifestyle change with new floor plans featuring kitchens that open out to seating areas, called hearth rooms. This change has been brought about because dining rooms are no longer the focal point for family meals or for entertaining guests. The current style of entertaining is more relaxed and informal for the majority of people. The main meal is likely to be served buffet style, but consumed by guests scattered around the den, kitchen and living room. It is prohibitively expensive to have a topper or glass sheet made for every surface in a home. And, it is not convenient for a host to replace under liner towels that have become saturated during a party. Hence, traditional methods are not practical in contemporary party settings.

Although USPTO patent documents do not reference a pad apparatus equivalent to the present invention, an analysis of this type of prior art is nonetheless important and will be approached in broad terms by considering two areas of technology that generally relate to absorbent barriers. Coasters and exudates pad technologies have been selected because they are both concerned with controlling liquid by-products. The argument developed hereinafter is that materials and methods employed by these two technologies cannot feasibly address the particular purposes of the present invention. Aside from the issue of precedence, the argument itself is worthwhile because it lays the path to a body of descriptive language and definitions that have already been established in prior art, notwithstanding that coasters and exudate pads have objectives vastly different from that of the present invention.

Coaster technology compares to the present invention in that it is concerned with condensate barriers that cooperate with beverage vessels to protect an underlying surface. More precisely, coasters are aimed at isolating a relatively small volume of water, contained within a glass, from a supportive surface for the relatively short time period required to consume a single portion of a beverage. In contrast, the present invention cooperates with vessels, containing multiple servings, that are in use for several hours. Another contrast is that many types of coasters are made of materials that lose cohesion when they are saturated with water, and for this reason are considered disposable. Disposability is thought of as an advantage in coaster technology, but this characteristic renders a coaster useless in absorbing and containing the amount of condensate produced by a vessel of ice such as a wine cooler. For example, U.S. Pat. No. 5,938,162 to Honjo (1999) discloses a coaster comprised of sodium polyacrulate reinforced with wax paper or materials with similar properties. Honjo's coaster is only effective until it becomes saturated with water; this is essentially a problem of limited capacity that is common to all coasters with absorptive features. U.S. Pat. No. 4,858,873 to Wilmouth and Wilmouth (1989) discloses a rigidly constructed coaster that features a reservoir to contain water. Any coaster design utilizing a reservoir to isolate water is vulnerable to the same problem as that of the under liner previously discussed—at some unpredictable point in time both an under liner and a coaster using a reservoir in its design must be emptied to prevent overflow, which is an inconvenience not found with the present invention. Another deficiency of coasters featuring a reservoir, such as that disclosed by Woodruff (1978) in U.S. Pat. No. 4,089,498 is that they cannot function with a variety of vessel shapes and sizes. Also, if Woodruff's invention could be adapted to the size necessary to cooperate with a multiserving vessel, it would be as unwieldy and heavy to use as a furniture topper. Indeed, all of the disadvantages of a furniture topper would also apply to an enlarged embodiment of Woodruff's invention. The present invention has the advantages of greater volume capacity and reusability, without the disadvantage of needing to be emptied during use. Also, the present invention is visually appealing, and functions well, with a variety of vessel shapes and sizes.

Although no one could reasonably suggest that a diaper or other pad used to capture body exudates is likely to be put to use in the same manner as the present invention, exudate pad technology must be considered because no other field of invention has so comprehensively examined the transmission of liquid through fabric pads. The exudate pad industry is interested in how the behavior of liquid molecules, absorbed into fabric components, changes or remains the same when these fabrics are organized into a pad, which is also a central issue of the present invention. And as importantly, this comprehensive examination by the exudate pad industry has yielded a body of descriptive language and terms well suited to the discussion of the present invention. U.S. Pat. No. 6,673,982 to Chen, et al. (2004) discloses an exudate pad with a barrier to prevent radial wicking in the plane of the pad. The object of the Chen, et al. pad is to provide "[. . . ] high permeability in the thickness direction but low permeability in the plane [. . . ]" to prevent leakage by preferentially holding fluids in the central region of an exudate pad (p. 1). Chen, et al. cite a general failure in the prior art of their field to prevent wicking from the center target region of the pad to its edges. Furthermore, these authors generalize all product failures in the exudate pad industry as quintessentially being failures to contain exudates in an absorbent core that is both isolated from the body at the target area of fluid intake and isolated from the edges of the pad. It is the overall aim of exudate pad technology to absorb and concentrate fluids within a centrally located core to prevent leakage or topsheet flow. This assertion finds further support in U.S. Pat. No. 6,306,123 to Salerno, et al. (2001), U.S. Pat. No. 6,448,466 to Ribeiro de Carvalho (2002), and U.S. Pat. No. 6,673,984 to Roe, et al. (2004). U.S. Pat. No. 6,610,903 to Latimer, et al. (2003) allows for some lengthwise transmission of fluid from the target area, but this is even so just an extension of the same industry objective, which is to entrap exudates in a circumscribed area within a pad, to bury exudates until the exudate pad is replaced. The present invention, however, purposes to accomplish the opposite by encouraging as much as possible the radial wicking of liquid away from the target area so that a maximum peripheral surface area for desorption is achieved. In summary, this type of prior art is usefully comparable to the present invention, but does not supersede the present invention because exudate pad technology endeavors to control liquids in an opposite manner.

To summarize the state of prior art, traditional methods of under liners, toppers, and glass sheeting have many disadvantages and none of the advantages of the present invention. Furthermore, published prior art fields of invention such as coasters and exudate pads do not address the need for an apparatus that isolates surfaces from condensate runoff, particularly runoff generated by multiserving vessels customarily in use for many hours.

SUMMARY OF THE INVENTION

To achieve the foregoing as well as other advantages, the present invention provides a pad assembled with its layers in specific positions that farm an interrelated structure including a flat, flexible wicking barrier jacketed by at least one absorbent layer covering its top side and at least one thermal insulative layer covering its bottom side; all of which are sewn into a seam around their edges, or otherwise attached to one another, and are as a unit encased within a fabric covering. It is not only this particular assembly that is important to note, but also that each layer functionally exploits the characteristics of its specified the of fabric. The wicking barrier is comprised of flexible, waterproof material such as vinyl or rubber coated fabric. The thermal insulative layer(s) is comprised of any fabric known to have thermal qualities such as cotton balling, wool, or name brand fabrics designed for the purpose. The absorbent layer(s) is comprised of cotton batting or other similar material. When a multiserving vessel is centered upon or over the pad apparatus, the absorbent layer (s) and fabric covering are capable of capturing condensate runoff from the vessel, and they are capable of wicking away moisture from the vessel. The wicking barrier layer, which is positioned below the absorbent layer previously described, blocks absorbed water from transmitting in the thickness direction down to a surface underlying the pad. The thermal insulative layer(s) blocks radiant cooling from the vessel that would otherwise transmit to the underlying surface, thereby possibly causing secondary condensate to form beneath the pad. The overall purpose of the pad apparatus being the protection of an underlying surface and the prevention of untidy water accumulation on the same surface.

The several parts of the pad apparatus each play a role in the absorption and containment of cold-water condensate as well as eventual release of this water. For the pad apparatus to provide the necessary absorptive capacity to contain the high volume of condensate generated by multiserving vessels, moisture absorbed into the pad must somehow be extracted during its use. Not only is this necessary for containment, but moisture lingering within the pad could allow mildew to form, which would cause the pad not to be reusable. The design of the present invention capitalizes on natural principles ,of diffusion, to direct moisture transmission through layers of the pad to draw condensate away from a cold vessel placed upon or over the pad's center until saturation and then desorption occur. Taking a closer look at the pad's functional process, condensation on the multiserving vessel moves into the pad's top fabric cover by the natural process of diffusion; the tendency of molecules to move to areas of lesser concentration. In this case, he water molecules are cold condensation formed on the outside of the multiserving vessel, and they move into the area of lesser concentration which is the dry fabric covering of the pad. It's easier to say the water is absorbed into the fabric covering. Movement into and within the fabric is accomplished by capillary action (a type of diffusion); the natural tendency of liquid molecules to prefer to bond with solids or rather, to be attracted to them. Capillary action is a preferred term over absorption or diffusion to explain this, particular part of the pad's workings because it relates fabric density to moisture movement by describing it in terms of molecules traveling through fabric by transpiring between yarns, between fibers and through he fibers themselves. To hammer home the point, the more fibers (density), the greater the attraction and movement of moisture. Capillary action is important here also because it makes it easier to understand why absorbed moisture does not first saturate the entire top fabric covering of the pad (in plane), but rather, the moisture begins to immediately travel in the thickness direction into the absorbent layer(s). The higher number of air pockets (low thread density) between threads comprising the fabric covering in combination with the higher density of fibers (less air pockets) in the absorbent layer(s) attracts moisture away from the fabric covering. The fabric covering is described as having low density because it has fewer fibers and more air pockets than the absorbent layer(s). The functional result of This density differential between the fabric covering and the absorbent layer(s) is that a wet target area of initial moisture intake forms in the center of the fabric covering, but the surrounding outer region of the fabric covering remains dry at this point in the process. Another way of saying this is that capillary action causes the moisture to preferentially move cross plane, straight down, instead of spreading out further in the fabric covering toward the perimeter of the pad. Below the fabric covering and the absorbent layer(s), is the wicking barrier layer, which stops water from penetrating farther down in the thickness direction. The term 'wicking barrier', is fabric industry parlance meaning waterproof. Continuing to describe the pad's function in terms of diffusion, as moisture concentration within the absorbent layer(s) increases, it has nowhere else to go by capillary action, until saturation occurs.

After initial moisture intake through the target area (i.e. the center of the top fabric covering) and saturation have of the absorbent layer(s), has occurred, the pad begins to dry ,or debsorb. Drying is aided by the fact that another moisture differential exists between a dry region of the fabric covering that surrounds the target area, and the underlying saturated layer(s). This functional combination of the saturated state of the absorbent layer(s) and the remaining dry area of the fabric covering also is a desorption field because it is an area—more a condition in two layers—that begins the release of moisture from the pad. It is this cooperation between layers that is really responsible for the pad's ability to dry rapidly. Next, water molecules are attracted toward the last available dry fibers within the pad; the moisture movement is 'upward' out of the saturated absorbent layer(s) because, according to principles of diffusion, there is nowhere else to go. As the previously dry region of the fabric covering is wetted from below, it becomes part of the desorption field because it becomes involved in releasing water molecules from the pad. As a reminder, much of the fabric covering remains dry during the initial intake of moisture because condensate does not rain down from the vessel onto the entire surface area of the fabric covering, but rather, droplets hug the vessel's exterior walls as they gravitate toward the pad. These condensate droplets are absorbed into the pad immediately around the vessel's footprint on the center of the pad (target area). Molecules of the droplets are first preferentially drawn cross plane into the absorbent layer(s), instead of traveling in plane within the fabric covering, because the absorbent layer(s) is denser (i.e., has more solid matter to attract liquid molecules and fewer air pockets) than the fabric covering. The top fabric covering is the only layer that serves two separate functions, depending on the concentration of water within the pad at any given time. The separate functions are those of initial absorption to capture water from a multiserving vessel, and of desorption to dry the pad. The top fabric covering allows moisture through to the absorbent layer(s) below, but in its role as part of the desorption field (after the absorbent layer(s) has become saturated), freely releases moisture as vapor into ambient air. In his discussion of fabric dying rate, Adanur writes: "The drying mechanism [of fabrics] consists of the water on the surface of the fibers evaporating into the surrounding air. Diffusion then causes water held within the fabric to come to the surface where it too can evaporate "(p. 634), Summarizing thus far, three elements cause an interaction between layers that represent the functioning 'parts' of the present invention: diffusion and capillary action; special fabric characteristics such as density and impermeability; and the structural position of each layer within the pad.

The first embodiment of the present invention is carried out with the multiserving vessel resting upon the target area of the pad apparatus. The functional parts of the pad apparatus are grouped for descriptive purposes into midportion layers and outer portion layers so they can be clearly and concisely compared to the second embodiment hereinafter. The midportion layers include the wicking barrier, the first absorbent layer, and the first insulative layer. The outer layers include the uppermost and bottommost fabric coverings, the second absorbent layer and the second insulative layer. The midportion layers are of a midportion size that is one inch smaller than the outer layers so that a bolster is created in the center of the pad to support the weight of a vessel. The additional thickness of the pad's center offsets the weight of the vessel so that the vessel is prevented from sinking into the pad. Like a husband in a hammock, it is undesirable for the edges of the pad to draw up as the pad's center is depressed. A "bowl", or hammock, configuration would impede wicking of absorbed moisture and it would disable the desorption field because moisture would remain concentrated in the lowest part of the pad instead of transmitting toward the perimeter. The pad's center must be thick enough to compensate for the weight of the vessel. Thus, in the first embodiment, a vessel placed atop the thickened center of the pad causes the pad to become evenly flat, meaning the edges are level with the center.

In the second embodiment of the present invention, all layers of the pad are the same size except for the wicking barrier. The wicking barrier must still fit inside the pad, so it remains relatively smaller than all the other layers. In the second embodiment, there is no bolstered, thickened center because this embodiment is not carried out with the vessel placed directly upon the pad. Rather, the vessel has some other attachment that supports it, and the pad lies beneath this support. For instance, the pad may lie on the floor beneath a champagne bucket supported by a stand; in this case only the feet of the stand are in contact with the pad. The second embodiment may also be carried out with any footed multiserving vessel, such as a footed chafing dish or footed wine cooler. In all instances of the second embodiment in use, the vessel's weight is redistributed by an attachment (feet, or legs of the stand) so that no interruption occurs in the dispersal of water within the pad. An additional advantage accrues to this second embodiment in that the desorption process is further enhanced by air circulating between the pad and the vessel, causing it to dry even more quickly.

To summarize, the primary purpose of the present invention is to absorb and contain condensate so that moisture is isolated from an underlying surface to prevent damage, or to prevent untidy water accumulation, on this surface. Toward accomplishing this end, the structure of the invention promotes desorption, thereby drying the pad apparatus so that it is reusable, and to enable the pad to continuously absorb water until equilibrium conditions are reached within the vessel. To further isolate the underlying surface from damaging moisture, the base of the pad apparatus functions as a thermal barrier, so that secondary condensate does not form beneath it on a surface.

As such, it is an object of the present invention to provide a new protective pad for use with a multiserving vessel to serve chilled beverages and food.

It is another object of the present invention to provide a new protective pad capable of absorbing and containing a constant intake of condensate for many hours.

Yet another object of the present invention is to provide a new protective pad that fosters evaporation of absorbed water.

It is a further object of the present invention to provide a new protective pad that requires no attendance to function (such as draining captured water during use or hanging to dry after its use).

An even further object of the present invention is to provide a new protective pad with a bolstered center to directly support heavy vessels containing multiple portions of food or beverages with ice.

Still yet a further object of the present invention is to provide a new protective pad that is easily stored, due to its size and pliability, in a small space such as a drawer or cabinet.

BRIEF DESCRIPTION OF THE DRAWINGS

FIG. 1 is an exploded view of the first embodiment 8 depicting the fabric layers of the invention, showing their order and relative diameter.

Figure 7:
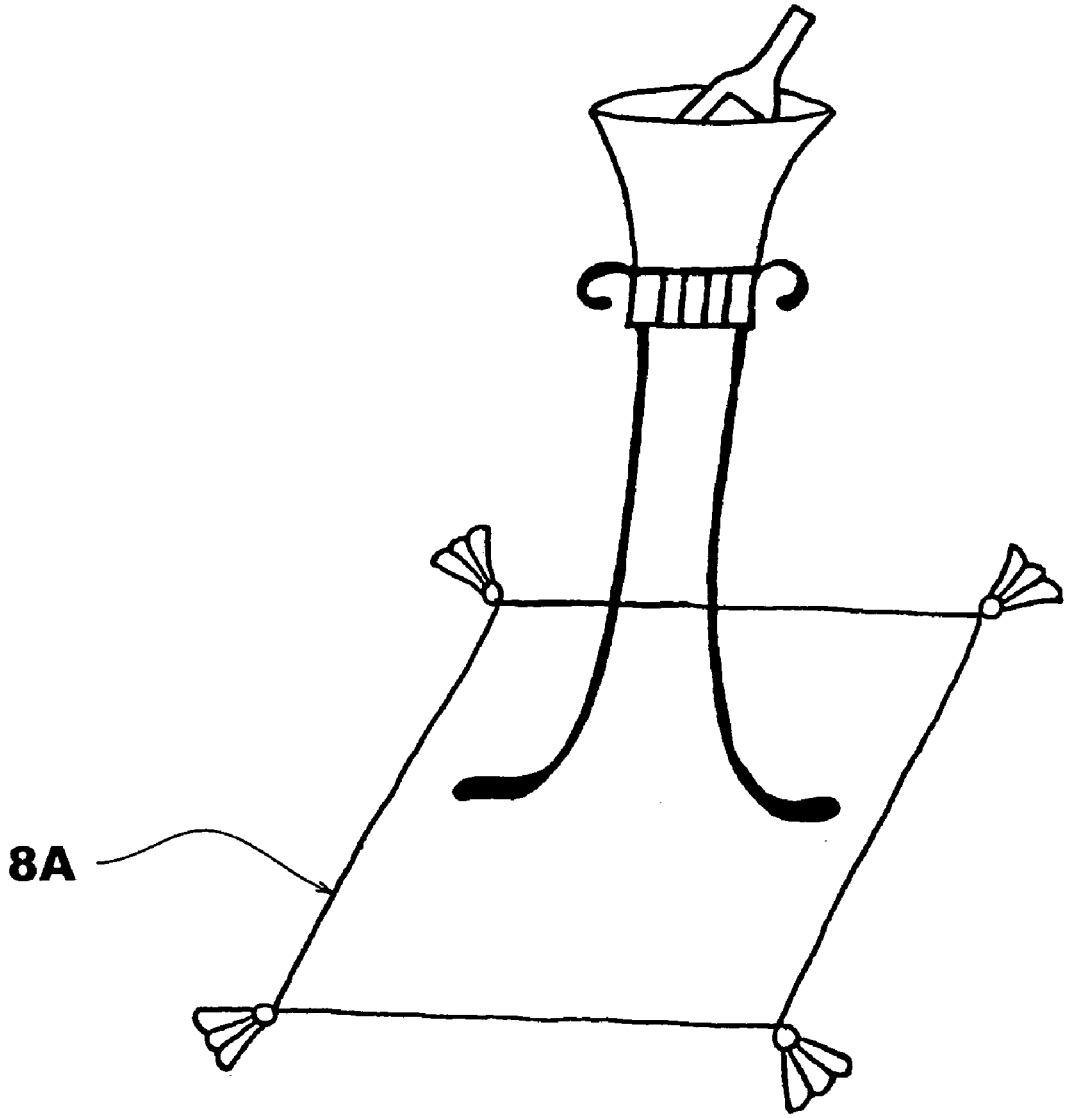

Identical hatching indicates that layers 1 and 7 (fabric coverings) have the same composition, cotton or other fabric with similar characteristics. Layers 2 and 3 (associated with moisture transmission) as well as layers 5 and 6 (associated with thermal blocking) are identified with matched hatching to show they are each comprised of cotton batting or fabric with similar characteristics. Layer 4 has unique hatching because it is the only layer comprised of wicking barrier material, such as coated fabric.

FIG. 2 is a sectional view of the first embodiment 8. The three midportion layers 3, 4, 5 have a relatively smaller diameter than the outer portion layers 1, 2, 6, 7. The midportion layers 3, 4, 5 are shown to be stitched together at their edges. Layer 5 is shown to be sewn to layer 6, thus the outer layers and midportion layers are indirectly all attached to one another.

FIG. 3 shows a perspective view of the first embodiment 8 fashioned into a round shape. The bolstered center of the invention is salient.

FIG. 4 shows the first embodiment 8 of the invention in use upon a tabletop supporting a large wine cooler. The bolstered center of the invention is obscured due to the flattening affect of the wine cooler.

FIG. 5 is an exploded view of the second preferred embodiment 8A of the present invention.

FIG. 6 is a sectional view of the second embodiment 8A. The three midportion layers 3, 4, 5 are the same diameter as the outer layers 1, 2, 6, 7. The edges of the midportion layers 3, 4, 5 are folded and sewn into a seam with the outer layers 1, 2, 6, 7.

FIG. 7 is a perspective view of the second embodiment 8A, fashioned into a square shape with decorative tassels, in use on a floor surface beneath a champagne bucket and stand.

DEFINITIONS

"Cover factor" is a known fabric industry term that describes fabric density more precisely than yarn count by expressing density as a ratio of interstices to solid matter. Cover factor is defined as "The ratio of fabric surface occupied by yarn to the total fabric surface [. . . ]" (Adanur, p. 625).

"Desorption Field" is an original term that in some instances refers to the part of the pad's fabric covering that extends between the target area and the perimeter edge(s) of the pad. This meaning is employed when the context demands that the desorption field and target area are distinguished from one another as parts of the fabric covering. Used in this context, the desorption field is the physical locus of the pad from which moisture is desorbed into ambient air. Alternatively, desorption field may describe the active result of the moisture differential existing between the dry part of the fabric covering and the saturated absorbent feature (i.e. layer). As such, when the absorbent feature and the adjacent fabric covering cooperate to set up a moisture differential, they may in combination be referred to as a desorption field. Like the more common term "evaporation field", a key feature of a desorption field is that it dynamically and statically manifests an expanded surface area to boost diffusion. The word "desorption" itself is common in the arena of fabric testing.

"Hydrophilic" describes the capability of a fabric to transmit moisture.

"Hygroscopic" refers herein to materials that "[. . . ] have the ability to absorb water in the form of vapor or liquid. Hygroscopic material will absorb moisture from, or release moisture to, the surrounding air until an equilibrium moisture content is attained" (Adanur, p. 589). Although the context of this quote is a discussion of fiber properties, Adanur also asserts elsewhere in the same work that a particular fabric's properties are determined by that of its yarns, and that yarn properties are governed by the properties of their component fibers (p. 625). Thus, the term "hygroscopic" may correctly be used herein to describe fabric characteristics.

"Layer" is herein generally a construct that equates to a functional part of the present invention. A particular functional part may be represented as two physical layers, such as is the case with the absorbent feature and the insulative feature; this is necessary to show how the pad can be adapted for different embodiments. The number of physical layers in the pad is not fixed, nor is the method of attachment between parts of the pad. For instance, the absorbent feature and the thermal feature could be embodied as laminate coatings bonded to the uppermost fabric covering and the bottommost fabric covering respectively. Additionally, for example, the technology exists to chemically merge a wicking barrier feature (by the impregnation of bitumen or polymeric sealing materials) in the top surface of the thermal feature, advantageously combining them into a single physical layer. Materials with different properties are commonly extruded into fibers or webs used to make a fabric with a specialized purpose. Thus, those skilled in the art of fabric manufacture or exudate pad design would consider these modifications as being solidly within the spirit and scope of the present invention.

"Multiserving vessel" is an original term that refers to a type of container used to serve multiple portions, i.e. servings, of chilled beverages and food during indoor social gatherings. These vessels have in common that they contain enough ice to maintain the temperature of their beverage or food contents for the several hours that they are typically in use. Some examples of these vessels are caviar servers, cold chafing dishes, drink tubs, ice buckets, jugs and pitchers, punch bowls, and wine coolers. Multiserving vessels sometimes have supportive feet. These vessels generate a continuous amount of condensate runoff until their ice contents have warmed to equilibrium; expected indoor atmospheric conditions are about 65% relative humidity and approximately 70° F. (21° C.).

"Secondary condensate" is a concept described in U.S. Pat. No. 4,089,498 to Woodruff (1978). Woodruff postulates that in conditions of high temperature and of high relative humidity, a vessel's adjunct device, such as a coaster, becomes chilled below the dew point, causing moisture from the air to condense on the surface of the adjunct device. Furthermore, Woodruff asserts that the relative warmth of the supportive surface also causes moisture to condense, and so it follows that condensate will be deposited on this surface. Secondary condensate is condensate that forms during the use of an adjunct device on a surface other than the walls of a multiserving vessel.

"Target area" refers to the center area of the fabric covering that is surrounded by the desorption field. If the vessel rests directly upon the pad, the target area is the place where the vessel makes contact with the pad, hence the area of moisture intake. If the vessel is suspended over the center of the pad, the target area is the area of initial moisture intake. Target area is a common term in the arena of exudate pad testing; it has been adapted to the purposes herein.

Detailed Specification

With reference to the drawings, a new protective pad apparatus will be described. There are two embodiments of this pad. The first embodiment is generally referred to and designated as 8; it is detailed in FIGS. 1, 2, 3 and 4. The second embodiment is generally referred to and designated as 8A, and is detailed in FIGS. 5, 6 and 7.

To construct the first preferred embodiment of the invention 8, all of the layers are cut into the same shape using paper templates, usually round, oval or square. In the art of sewing, the use of paper templates is a common procedure. There is a template of an outer layer size for 1, 2, 6, 7, and a template of an midportion size for layers 3, 4, 5. The midportion template is one-quarter inch smaller than the outer layer template. When the edges of the outer layers 1, 2, 6, 7 are sewn into a one-quarter-inch seam, the midportion layers 3, 4, 5 fit neatly into the interior cavity of the pad 8 as is shown in FIG. 2.

The midportion parts 3, 4, 5 are first sewn together to create the bolster. As is illustrated by FIGS. 1 and 2, layers 3, 4, 5 are stacked atop each other and then centered upon layer 6. An overcast stitch, depicted in FIG. 2 by a vertical zigzag line, that punctures and joins 3, 4, 5, and 6 together is sewn around the edge of 3. Thus, the central bolster, comprised of 3, 4, 5, is securely attached to outer layer 6, preventing the bolster from buckling or shifting within the finished pad 8.

The layers of FIG. 1 are ultimately joined together with a seam, which is illustrated in FIG. 2 by vertical zigzag lines connecting the outer layers 1, 2, 6, 7. The steps required to make a seam are well known to those practiced in the art of sewing, but fundamentally they involve putting together layers of fabric in reverse order (right sides placed back to back) stitching to join the pieces together at their edges, and then once sewn together, the whole item is pulled inside out so that the layers are again in the order depicted in FIGS. 1 and 2 for the finished pad 8. Pillows and many other common items are constructed by the same method. FIG. 3 shows the finished pad 8.

Referring to FIG. 5, the second embodiment of the invention 8A is shown to have the same number of layers as the first embodiment 8 (FIG. 1), and these layers have the same position as well as composition as the layers of the first embodiment 8. The difference is that layers 3 and 5 have not been shortened to create the bolstered center of the first embodiment 8.

To construct the second embodiment of the present invention 8A, the same two paper templates are used as for the first embodiment 8. The template that is of an outer layer size is used to cut layers 1, 2, 3, 5, 6 and 7. Only layer 4 is cut using the template of a midportion size, which is one-quarter inch smaller than the template of an outer layer size. FIG. 5 also shows that layer 4 is sewn to layer 5 to prevent it 4 from "floating" or buckling within the pad 8A. As is shown in FIG. 6, layers 3 and 5 are folded into the seam along with layers 1, 2, 6 and 7, which is not the case in the first embodiment 8 (FIG. 2).

FIG. 7 shows that the second embodiment 8A has an overall flat aspect, rather than having a thickened center. The second embodiment 8A is carried out differently than the first embodiment 8 (FIG. 4) in that it 8A does not directly support its vessel so there is no need for a bolster. As is also evident in FIG. 7, air is able to circulate between the vessel and the second embodiment of the pad 8A, further aiding desorption.

It is now clear from the foregoing that the first 8 and second 8A embodiments share the same concept but they are carried out differently, and this difference is reflected in the modified structure of the second embodiment 8A. Next, the composition and function of each of the layers as they relate to the drawings will be clarified.

It is not necessary to distinguish between embodiments 8, 8A when discussing layer composition because they do not differ. Each corresponding layer serves the same function and has the same composition across embodiments. Instead, further discussion settles on how function dictates composition for each layer. The function of the uppermost layer 1 (also 2, 3) is absorption and desorption; secondarily, the uppermost layer 1 is decorative. Using fabric industry parlance, this layer 1 is specified to have a cover factor of less than 1.0, which means, for the purposes herein, that open spaces exist between yarns. Cover factor is an important specification because the present invention relies upon a sufficient density of yarns per square inch to absorb moisture, and it depends equally on an adequate number of open spaces between yarns for moisture desorption. A range of values less than 1.0 is suitable to the task. Bleached and scoured cotton, linen, and rayon are known to be particularly hydrophilic, which makes them ideal components for layer 1. The function of the bottommost layer 7 (also 5, 6) is that of thermal insulation. Thermal insulation in fabrics is dependent on density because "Tightly woven fabrics of high cover factor will not permit as much air flow [. . . ]" (Adanur, p. 631). It follows then that the specification for the bottom, insulative layers 5, 6, 7 is a cover factor of 1.0 or greater. Heretofore for descriptive simplicity, cotton batting was used to describe both absorptive layers 2, 3 and insulative layers 5, 6 because this fabric usefully has characteristics suited to both functions. The above explanation of cover factor, however, makes it clear that a wide variety of materials are suitable, as long as each has an adequate ratio of yarns to open spaces for its purposed function. In general, as the cover factor value varies for a particular material, so does its effectiveness within the pad apparatus. It is not necessary to describe the wicking barrier in terms of cover factor. The preferred materials to perform the function of this layer 4 are coated fabrics, laminates and some non-wovens because they can be flexible, lightweight, thin, and waterproof.

The invention claimed is:

1. An absorbent pad adjunct, having a plurality of fabric layers of an outer layer size joined by a seam; having a bolstered center means, including a plurality of substantially fabric layers of a mid-portion size surrounding and attached to a third-layer wicking barrier, for use with multi-serving vessels to capture dripped condensate from said multi-serving vessels, comprised of:

a. top-layer moisture intake means of an outer-portion size, including at least one piece of cotton fabric, whereby condensate from a multi-serving vessel is drawn into the pad by capillary action; and b. second-layer absorbent means of an outer-portion size, including a piece of cotton batting, whereby moisture is contained until saturation occurs, and then released by process of diffusion; and c. third-layer wicking barrier means of a mid-portion size, including a piece of coated fabric, whereby absorbed moisture is blocked and diverted radially, spreading further by process of diffusion; and d. bottom-layer thermal barrier means of an outer-portion size, including at least one piece of cotton batting, whereby radiant cooling is blocked, preventing secondary condensate from forming beneath the pad.

* * * * *